US006099323A

United States Patent [19]

Ho et al.

[11] Patent Number: 6,099,323

[45] Date of Patent: Aug. 8, 2000

[54] ELECTRIC CONNECTOR HAVING MODULE RETAINING DEVICE

[75] Inventors: Yu-Ming Ho, Pen-Chiao; Yao-Chi Huang, Yung-Ho, both of Taiwan

[73] Assignee: Hon Hai Precision Ind. Co., Ltd., Taipei Hsien, Taiwan

[21] Appl. No.: 09/211,295

[22] Filed: Dec. 14, 1998

[30] Foreign Application Priority Data

Dec. 15, 1997 [TW] Taiwan ..... 86220908

[51] Int. Cl.[7] ..... H01R 12/00

[52] U.S. Cl. ..... 439/64; 439/159

[58] Field of Search ..... 439/64, 297, 298, 439/374, 377, 541.5, 573

[56] References Cited

U.S. PATENT DOCUMENTS

| | | | |
|---|---|---|---|
| 5,297,966 | 3/1994 | Brennian, Jr. et al. | 439/64 |
| 5,643,001 | 7/1997 | Kauffman et al. | 439/159 |
| 5,980,299 | 11/1999 | Davis | 439/377 |
| 6,030,251 | 2/2000 | Stark et al. | 439/377 |

*Primary Examiner*—Brian Sircus
*Assistant Examiner*—Michael C. Zarroli

[57] ABSTRACT

An electrical connector having retaining device comprises a dielectric housing defining a mating face. At least a pair of standoff extend downward from an under face of the housing for mounting on a printed circuit board. The housing defines a longitudinal groove extending along the mating face. A plurality of terminals each has its contacting portion protruding from an inner wall of the groove. Each terminal has its soldering leg extending beyond the under face. A pair of retaining device mount onto the printed circuit board adjacent transverse ends of the housing. The retaining devices jointly define a receiving a receiving slot for an electrical module. Each the retaining device includes a plate portion defining a supporting face and an under face opposite the supporting face. At least a mounting pad extends downward from the under face of the plate portion for mounting on the printed circuit board. A wall portion extends vertically from an edge of the plate portion for guiding the electrical module when the module inserts to the slot. This wall portion also has retaining recess that engages a portion of an inserted electric module. A locking device securely attaching the plate portion to the printed circuit board.

17 Claims, 5 Drawing Sheets

ELECTRIC CONNECTOR HAVING MODULE RETAINING DEVICE

FIELD OF THE INVENTION

The present invention relates to an electrical connector, and more particularly to an electrical connector having a retaining device for retention of an electrical module therein.

DESCRIPTION OF THE PRIOR ART

Conventionally, a CPU is soldered onto a motherboard. Then the CPU is mounted by means of a socket connector, such as a socket 7 for 80686 of Intel. In Pentium series the CPU is a module and is mounted onto a slot-typed connector. In the very beginning, the CPU module inserts vertically into the slot-typed connector. Nevertheless, in order to dissipate heat generated from the CPU module, a heat sink together with a cooling fan assembly to the CPU module to facilitate heat dissipation. However, the increased weight hinders the electrical connection between the CPU module and the slot-typed connector. This insufficient connection will not survive when the module operates in a severe environment.

SUMMARY OF THE INVENTION

An objective of this invention is to provide a retaining device for use with an electrical connector in which an inserted module can be securely supported.

Another objective of this invention is to provide a retaining device for use with an electrical connector in which a portion of the module can be engaged with the retaining device thereby preventing the module from disengagement therefrom.

"In order to achieve the objectives set forth, a retaining device for use with an electrical connector comprises a plate portion defining a supporting face and an under face opposite the supporting face. The retaining device can be attached to transverse end of a housing of the connector. At least a mounting pad extends downward from the under face of the plate portion for mounting on a printed circuit board. A wall portion extends vertically from an edge of the plate portion for guiding the electrical module when the module is inserted. A locking device securely attaches the plate portion to the printed circuit board."

These and additional objectives, features, and advantages of the present invention will become apparent after reading the following detailed description of the preferred embodiments of the invention taken in conjunction with the appended drawing figures.

DETAILED DESCRIPTION OF PREFERRED EMBODIMENT

Figure 1:
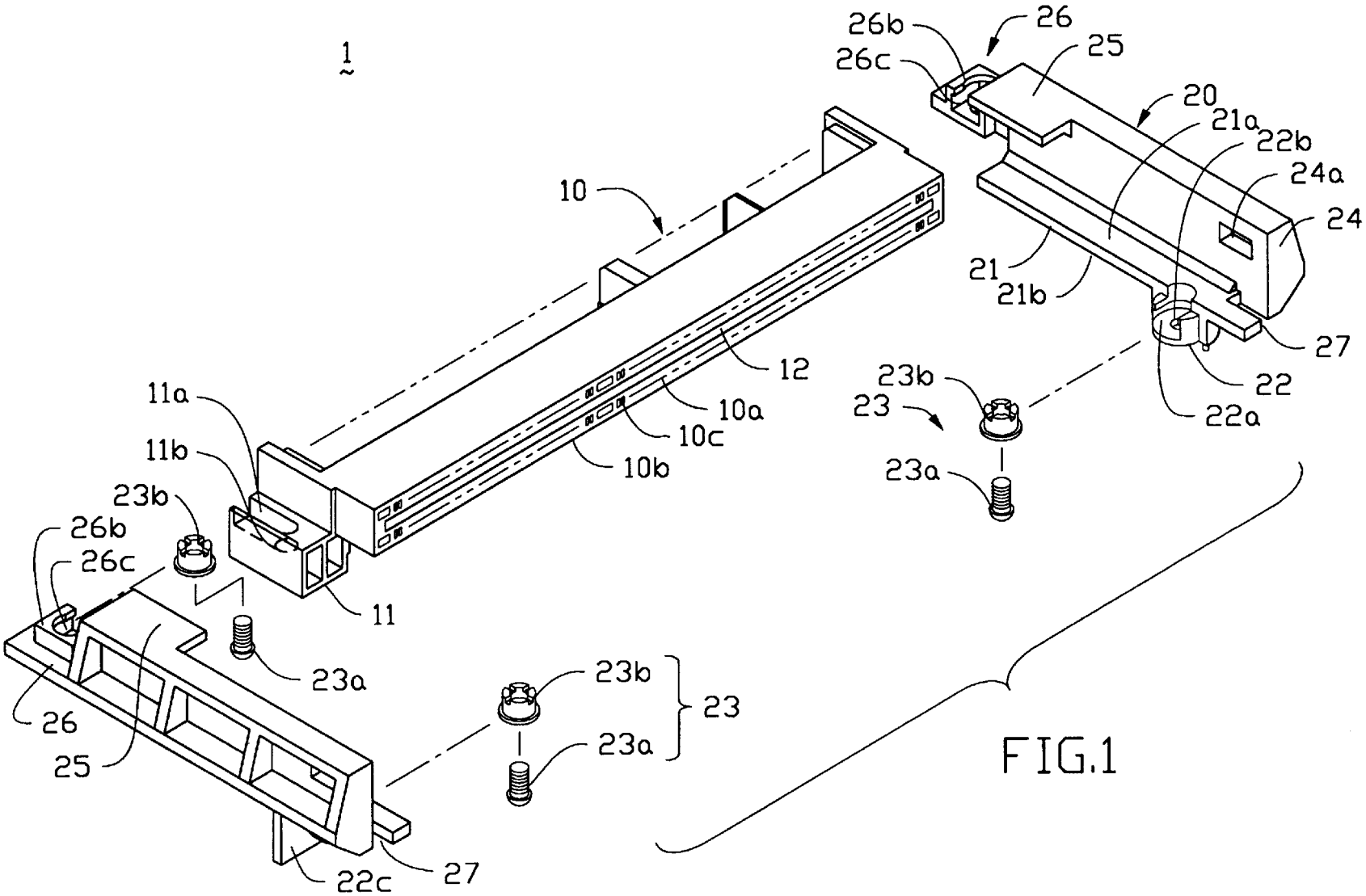
FIG. 1 is an exploded perspective view of an electrical connector in accordance with the present invention.

Referring to FIG. 1, an electrical connector 1 in accordance with the present invention includes a pair of retaining devices 20 arranged on transverse ends of the connector 1. The connector 1 includes a dielectric housing 10 defining a mating face 10*a* thereof. At least a pair of standoffs 11 extend downward from an under face 10*b* of the housing 10 for mounting on a printed circuit board (not shown). The housing 10 defines a longitudinal groove 12 extending along the mating face 10*a*. The housing 10 further defines a plurality of passageways 10*c* each receiving a terminal therein (not labeled). Each terminal has a contacting portion protruding from an inner wall of the groove 12 and each terminal has a soldering leg extending beyond the under face 10*b* for mounting onto a printed circuit board. In the preferred embodiment, the standoff 11 is integrally formed on transverse ends of the housing 10. Each standoff 11 defines a guiding slot 11*a* thereon. The standoff 11 defines a through hole 11*b* which passes through the guiding slot 11*a*.

A pair of retaining devices 20 are arranged on transverse ends of the housing 10. The retaining devices 20 jointly defining a receiving slot 30 for an electrical module (not shown). Each retaining device 20 includes a plate portion 21 defining a supporting face 21*a* and an under face 21*b* opposite the supporting face 21*a*.

At least a mounting pad 22 extends downward from the under face 21*b* of the plate portion 21 for mounting on the printed circuit board. The mounting pad 22 defines a circular recess 22*a* for receiving a nut 23*b* of a locking device 23. The circular recess 22*a* further defines a hole 22*b* and a bolt 23*a* of the locking device 23 may pass therethrough. A supporting tab 22*c* extends from the mounting pad 22 of the plate portion 21. The supporting tab 22*c* provides a solid support to the retaining device 20. A dowel pin 22*d* extends downward from an under face of the mounting pad 22. The dowel pin 22*d* may insert into a hole on the printed circuit board (not shown).

Figure 2:
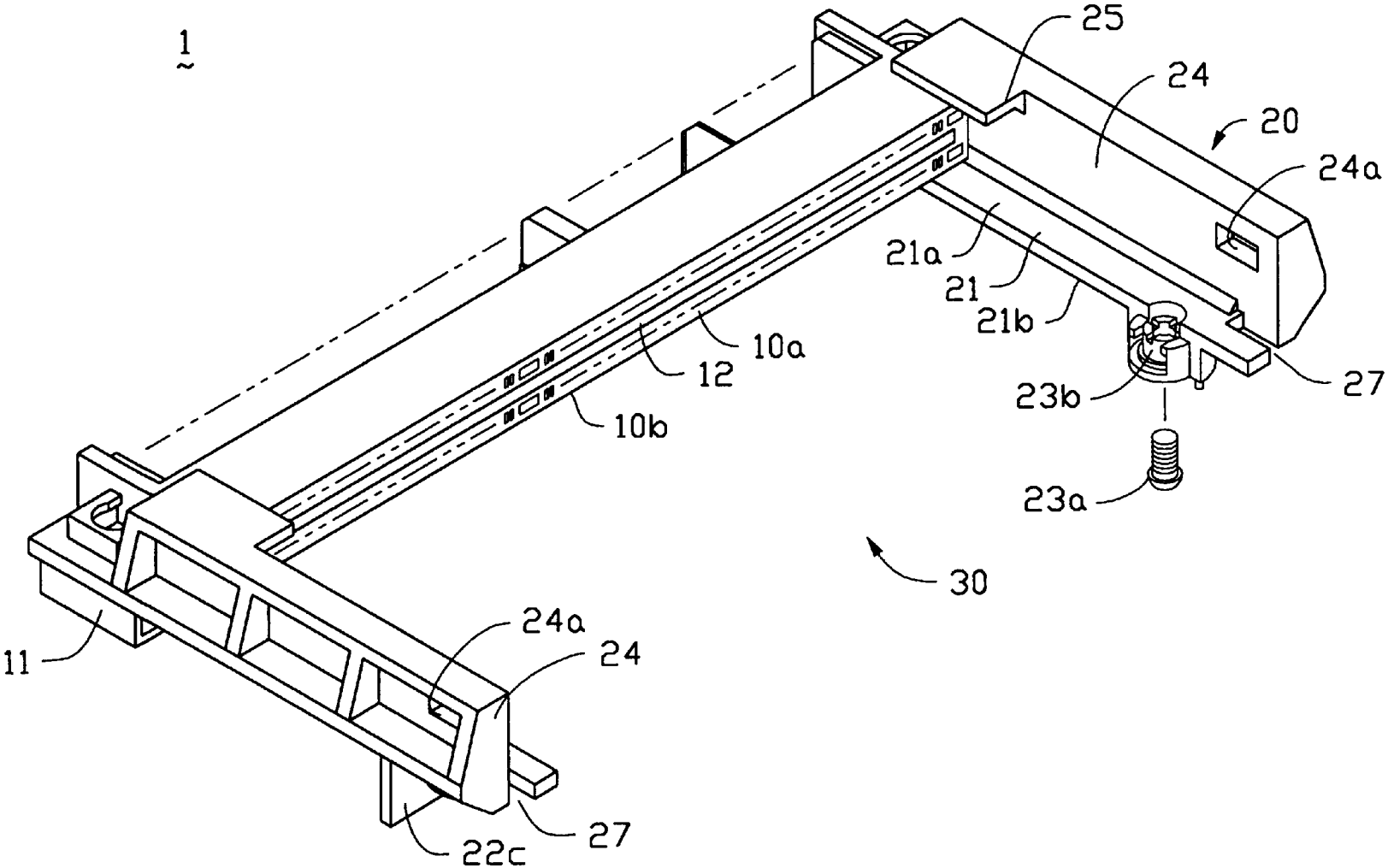
FIG. 2 is an assembled view of the electrical connector of FIG. 1.

A wall portion 24 extends vertically from an edge of the plate portion 21 for guiding an inserted module (not shown). The wall portion 24 defines a retaining recess 24*a* for engaging with a portion of the inserted module (not shown). A flange 25 extends from an upper end of the wall portion 24. At least a portion of the housing 10 is covered by the flange 25 (FIG. 2).

Figure 3:
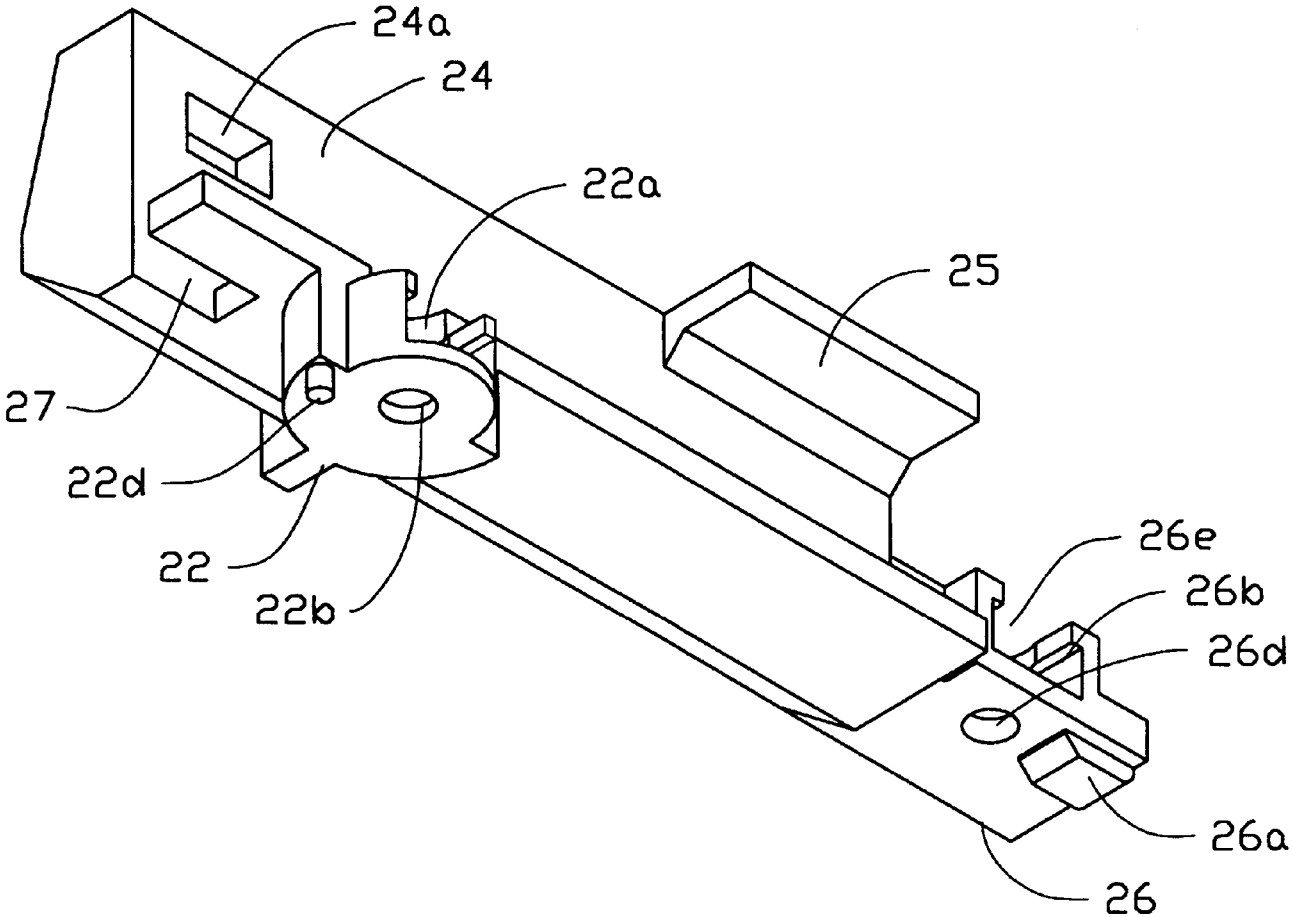
FIG. 3 is a perspective view of a retaining device.

The plate portion 21 further includes a wing portion 26 at an end thereof. Said wing portion 26 forms a guiding wedge 26*a* thereunder (FIG. 3). The guiding wedge 26*a* is received within the guiding slot 1 a of the standoff 11. The wing portion 26 further forms a seat 26*b* opposite the guiding wedge 26*a*. The seat 26*b* defines a recess 26*c* for receiving the nut 23*b* therein. The recess 26*c* defines a hole 26*d* (FIG. 3) therethrough. By this arrangement, the wing portion 26 of the retaining device 20 can be assembled to the standoff 11 of the housing 10. After the guiding wedge 26*a* is seated within the guiding slot 11*a*, the bolt 23*a* is inserted to lock with the nut 23*b* thereby securely connecting the retaining device 20 to the housing 10. By this arrangement, an inserted module can be firmly supported by the retaining device 20. Consequently, the connection between the module and receiving slot 12 of the housing 10 will not be hindered.

On the other hand, the plate portion 21 defines a clipping groove 27 for engaging with a portion of the inserted module. By this arrangement, an upward movement of the inserted module can be hindered.

Figure 4:
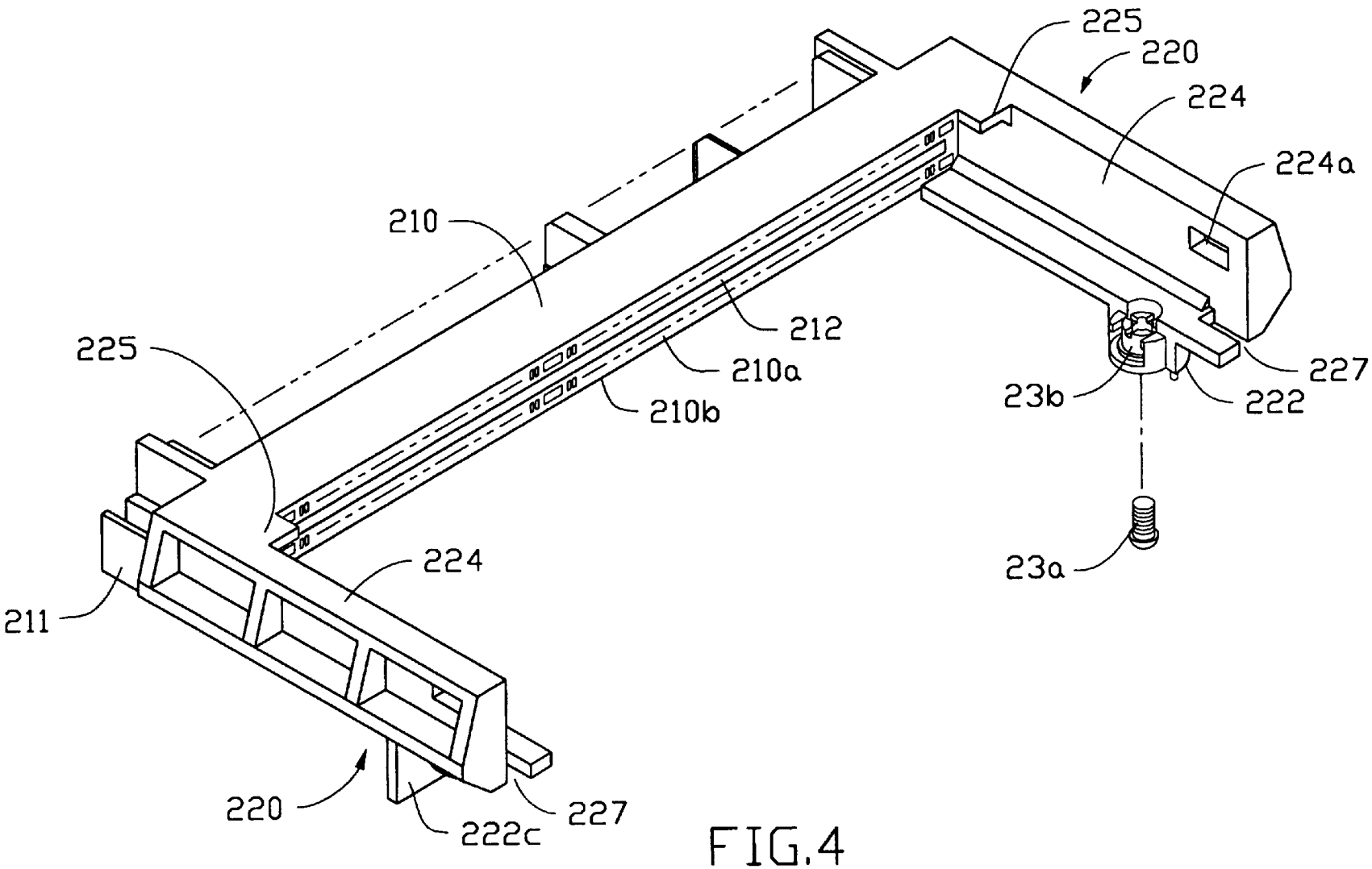
FIG. 4 is a second embodiment of an electrical connector in accordance with the present invention.

FIG. 4 is a second embodiment of an electrical connector 2 in accordance with the present invention. The dielectric housing 210 is integrally formed with a pair of retaining devices 220 on transverse ends thereof. This arrangement may simplify the mounting of the electrical connector 2.

Figure 5:
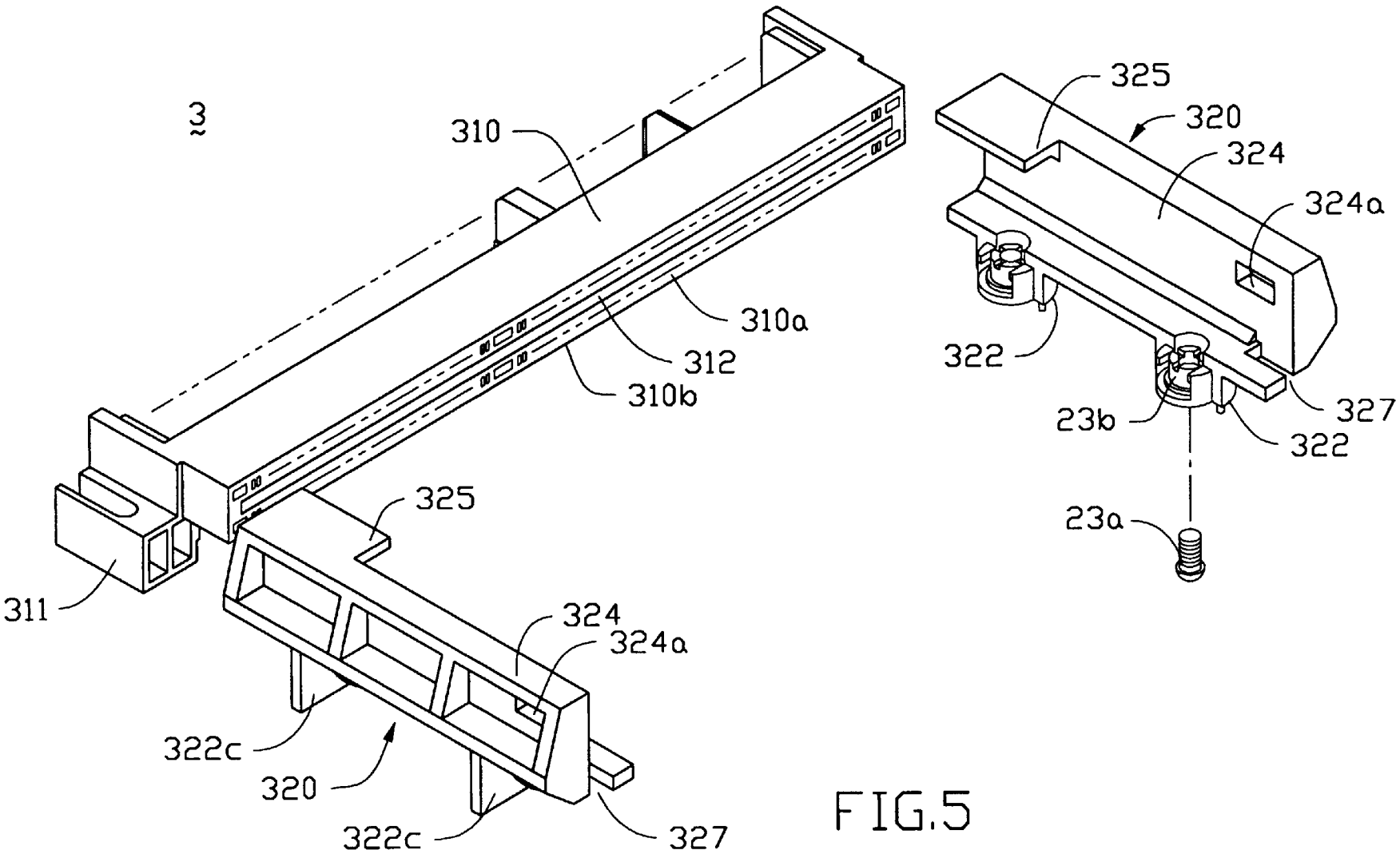
FIG. 5 is a third embodiment of an electrical connector in accordance with the present invention.

FIG. 5 is a third embodiment of an electrical connector 3 in accordance with the present invention. In this embodiment, a retaining device 320 includes a pair of mounting pads 322 and the wing portion 26 of first embodiment is omitted. This also achieve the objectives set forth.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector having retaining device, comprising:

a dielectric housing defining a mating face, pair of standoff extending downward from an under face of said housing for mounting on a printed circuit board, said housing defining a longitudinal groove extending along said mating face, a plurality of terminals each having its contacting portion protruding from an inner wall of said groove, each terminal having its soldering leg extending beyond said under face; and a pair of retaining devices mounted onto said printed circuit board adjacent transverse ends of said housing, said retaining devices jointly defining a receiving slot for an electrical module, each said retaining device, including:

a plate portion defining a supporting face and an under face opposite said supporting face;

a mounting pad extending downward from said under face of said plate portion for mounting on said printed circuit board;

a wall portion extending vertically from an edge of said plate portion for guiding said electrical module when said module inserts to said slot; and a locking device securely attaching said plate portion to said printed circuit board; wherein said wall portion defines a retaining recess for engaging a portion of said electrical module.

2. The electrical connector as recited in claim 1, wherein a flange extends horizontally from an edge of said wall portion.

3. The electrical connector as recited in claim 2, wherein said flange covers at least a portion of said housing.

4. The electrical connector as recited in claim 1, wherein said locking device includes a bolt and a nut.

5. The electrical connector as recited in claim 4, wherein said mounting pad defines a circular recess for receiving said nut of said locking device.

6. The electrical connector as recited in claim 1, wherein at least a supporting tab extends from said mounting pad of said plate portion.

7. The electrical connector as recited in claim 1, wherein a pair of standoffs are disposed adjacent to transverse ends of said housing, each standoff defining a guiding slot.

8. The electrical connector as recited in claim 1, wherein said guiding slot defines a through hole thereon.

9. The electrical connector as recited in claim 8, wherein said plate portion includes a wing portion at an end thereof, said wing portion forming a guiding wedge thereunder, said guiding wedge being received within said guiding slot of said standoff.

10. The electrical connector as recited in claim 9, wherein said wing portion forms a seat for receiving a nut therein.

11. A retaining device for use with an electrical connector, said retaining device being mounted onto a printed circuit board and adjacent transverse ends of a housing of said connector, comprising:

a plate portion defining a supporting face and an under face opposite said supporting face;

a mounting pad extending downward from said under face of said plate portion for mounting on said printed circuit board;

a wall portion extending vertically from an edge of said plate portion for guiding said electrical module when said module inserts to said slot; and a locking device securely attaching said plate portion to said printed circuit board; wherein said wall portion defines a retaining recess for engaging a portion of an electrical module.

12. The electrical connector as recited in claim 11, wherein a flange extends horizontally from an edge of said wall portion.

13. The electrical connector as recited in claim 12, wherein said flange covers at least a portion of said housing.

14. The electrical connector as recited in claim 11, wherein said locking device includes a bolt and a nut.

15. The electrical connector as recited in claim 14, wherein said mounting pad defines a circular recess for receiving said nut of said locking device.

16. The electrical connector as recited in claim 11, wherein at least a supporting tab extends from said mounting pad of said plate portion.

17. An electrical connector having retaining device, comprising:

a dielectric housing defining a mating face, said housing defining a longitudinal groove extending along said mating face, a plurality of terminals each having its contacting portion protruding from an inner wall of said groove, each terminal having a soldering leg protruding from an inner wall of said groove, each terminal having a soldering leg for mounting to a printed circuit board; and a pair of retaining devices respectively positioned at transverse ends of said housing and close to said mating face, said retaining devices jointly defining a receiving slot for an electrical module, each of said retaining devices, including:

a plate portion defining a supporting face and an under face opposite said supporting face;

a wall portion extending vertically from said plate portion for guiding said electrical module when said module is inserted to said slot;

a wing portion formed about a rear end of the retaining device and connected to the corresponding transverse end of the housing;

a locking device for securely attaching said plate portion to said printed circuit board; and a mounting pad positioned around a front end of the retaining device; wherein the wing portion is offset from the mounting pad in a vertical direction and is seated on a standoff positioned at the corresponding transverse end of the housing for indirectly securing to the printed circuit board while the mounting pad is adapted to be directly mounted to the printed circuit board.

* * * * *